US006799645B2

(12) United States Patent
Mason et al.

(10) Patent No.: US 6,799,645 B2
(45) Date of Patent: Oct. 5, 2004

(54) METHOD AND APPARATUS FOR DRILLING AND COMPLETING A WELL WITH AN EXPANDABLE SAND CONTROL SYSTEM

(75) Inventors: David Mason, Katy, TX (US); Brian Tarr, Houston, TX (US)

(73) Assignee: Shell Oil Company, Houston, TX (US)

( * ) Notice: Subject to any disclaimer, the term of this patent is extended or adjusted under 35 U.S.C. 154(b) by 15 days.

(21) Appl. No.: 10/314,561

(22) Filed: Dec. 10, 2002

(65) Prior Publication Data

US 2004/0108140 A1 Jun. 10, 2004

(51) Int. Cl.[7] ..... E21B 7/00; E21B 23/00

(52) U.S. Cl. ..... 175/57; 166/207; 166/227; 166/380; 175/314

(58) Field of Search ..... 175/22, 23, 57, 175/314; 166/206, 207, 227, 380, 382

(56) References Cited

U.S. PATENT DOCUMENTS

| | | | | | |
|---|---|---|---|---|---|
| 2,083,389 | A | * | 6/1937 | Moore | 175/314 |
| 2,942,670 | A | * | 6/1960 | Erwin et al. | 166/205 |
| 4,363,366 | A | * | 12/1982 | Hilty | 175/314 |
| 4,441,561 | A | | 4/1984 | Garmong | 166/387 |
| 5,186,265 | A | * | 2/1993 | Henson et al. | 175/107 |
| 5,323,852 | A | * | 6/1994 | Cornette et al. | 166/51 |
| 6,196,336 | B1 | | 3/2001 | Fincher et al. | 175/101 |
| 6,371,203 | B2 | * | 4/2002 | Frank et al. | 166/207 |
| 6,431,292 | B2 | * | 8/2002 | Mocivnik et al. | 175/314 |
| 2003/0183395 | A1 | * | 10/2003 | Jones | 166/380 |
| 2004/0011534 | A1 | * | 1/2004 | Simonds et al. | 166/384 |

FOREIGN PATENT DOCUMENTS

| | | |
|---|---|---|
| GB | 2357101 | 8/2001 |
| WO | WO 00/61310 | 10/2000 |
| WO | WO 00/61915 | 10/2000 |

* cited by examiner

*Primary Examiner*—Hoang Dang

(57) ABSTRACT

A system for controlling sand has an expandable screen an an inner string to isolate the sand screen allowing for drilling fluids to be circulated to the bottom of the drilling assembly, before returning up the annulus in normal fashion. Both ends of the expandable screen are mount on an inner string. The inner string is integral with the internals of the bottomhole drilling assembly, allowing for retrieval thereof, including a pilot bit. Upon retrieval an isolation valve will close and seal thus providing sand control integrity in the well. Release from the sand screen will be by pumping a ball down the string and engaging this in a catcher to slim the sliding sleeve open, giving hydraulic access to the liner hanger and engaging slips in the previous casing. Further pressure will release the ball into a catcher, restoring communication through the drill string.

8 Claims, 1 Drawing Sheet

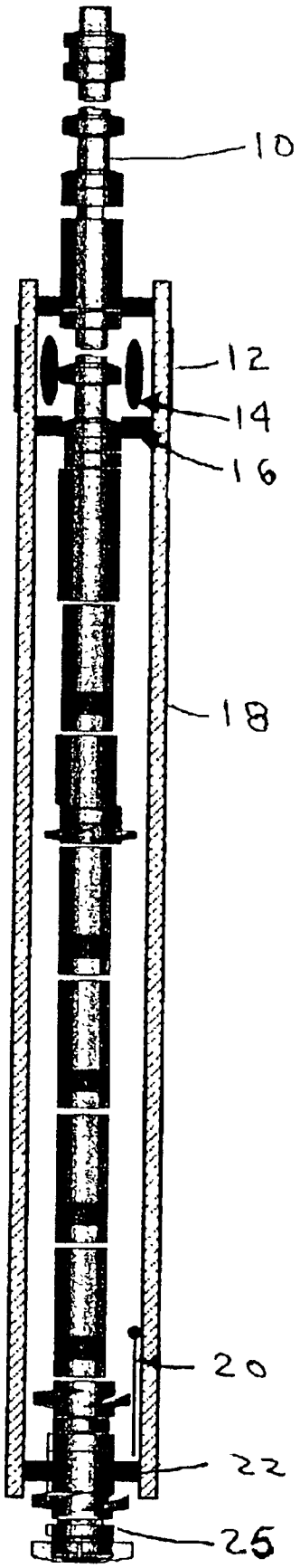
10
12
14
16
18
20
22
25

METHOD AND APPARATUS FOR DRILLING AND COMPLETING A WELL WITH AN EXPANDABLE SAND CONTROL SYSTEM

BACKGROUND OF THE INVENTION

1. The Field of the Invention

The present invention pertains to a method and apparatus for drilling and completing a well.

2. The Prior Art

Sand control systems, employing expandable screens, are often used for sand control in well completions. To date, it has only been possible to install them following drilling of the hole for installation. This takes time to execute and carries a risk that the hole may collapse following drilling but prior to screen installation.

U. S. Pat. No. 6,196,336 to Fincher et al describes a method and apparatus for drilling a borehole in underground formations with at least one formation that has a significantly different formation pressure than an adjacent formation or where time dependant unstable formations do not allow sufficient time to case off the hole in a subsequent run.

British Patent No. 2,357,101 to Hahn et al describes a method and apparatus for drilling wellbores by drilling a pilot wellbore and, with a trailing under reamer, enlarging the wellbore to the desired size. At least one steering section provides relatively precise directional control. An expandable liner may be used during the drilling process, which liner can be expanded in order to retrieve the drilling assembly while avoiding a secondary operation to expand the liner.

PCT Publication WO 00/61310 to Coon et al describes a method for manufacture of substantially cylindrical pipe at an on site workshop by rolling flat metal stock into a round section and sealing the seam between the stock edges.

PCT Publication WO 00/61915 to Coon et al describes a method for drilling a wellbore in an underground formation using a drilling tubular which is capable of being expanded in place. A radial load is applied to the tubular to expand it to line the borehole. Preferably a sealing material is pumped between the drilling tubular and the wellbore wall prior to expanding the drilling tubular.

A sand control system employing an expandable screen (mounted on either solid or slotted pipe) has an inner string to isolate the expandable screen. This allows for drilling fluids to be circulated to the bottom of the drilling assembly, before returning up the annulus as normal. Both the upper and lower parts of the expandable screen are mounted on the inner string by means of a swivel and seals. The swivel allows for drill string rotation (if needed), the seals ensure that drilling fluids do not circulate to the inside of the screen.

The inner string is integral with the internals of the bottomhole drilling assembly, allowing for retrieval of the BHA (bottomhole assembly), including a pilot bit. Upon retrieval an isolation valve will close and seal thus providing sand control integrity in the well.

Release from the sand screen will be by pumping a ball down the string and engaging this in a catcher to shift the sliding sleeve open, giving hydraulic access to the liner hanger and engaging slips (or other setting mechanism) in the previous casing. Further pressure will release the ball into a catcher, restoring communication through the drill string in case this is needed for well control or circulation purposes.

It is proposed to run an expandable sand control system (sand screens mounted on either solid or slotted pipe) on an inner drill pipe string. By having swivels and wall between the pipe and the screens, drilling fluids can be circulated to the bottom of the drilling assembly, before returning up the annulus as normal. The swivel also allows for rotation of the drill string, if needed. The drill string includes a bottomhole assembly comprising drill bit and associated tools. When the bottomhole assembly is at the required depth, the bottomhole assembly will be released from the sand screen by pumping a ball down the string and engaging in a suitable profile to shift the sliding sleeve open, giving hydraulic access to the liner hanger and engaging slips (or other setting mechanism) in the previous casing string. Further pressure will release the ball into a catcher, restoring communication through the drill string in case this is needed for well control or circulation purposes.

The bottomhole assembly can then be removed from the expandable screens, which have then been placed in the hole without risk of borehole collapse.

Expansion may then be carried out by conventional means (using compliant expansion tools) or by means of an expansion cone included in the bottomhole assembly behind the drill bit.

SUMMARY OF THE INVENTION

The subject expandable sand control system has an inner string to isolate a sand screen allowing for drilling fluids to be circulated to the bottom of the drilling assembly before returning up the annulus in the normal fashion. Both the upper and lower parts of the sand screen are mounted on the inner string by means of swivels and seals. The swivels allow for drill string rotation (if needed), the seals ensure that drilling fluids do not circulate to the inside of the screens. The inner string is integral with the internals of the bottomhole drilling assembly, allowing for retrieval thereof, including a pilot bit. An isolation valve will close and seal, upon retrieval, thus providing sand control integrity in the well. Release from the sand screen will be by pumping a ball down the string and engaging this in a catcher to slim the sliding sleeve open, giving hydraulic access to the liner hanger and engaging slips (or other setting mechanism) in the previous casing. Further pressure will release the ball into a catcher thereby restoring communication through the drill string for well control or circulation purposes.

BRIEF DESCRIPTION OF THE DRAWINGS

The present invention will now be described, by way of example, with reference to the accompanying drawings in which the single FIGURE is a schematic representation of the subject invention showing how is used.

DETAILED DESCRIPTION OF THE INVENTION

The single FIGURE shows a drill pipe 10 which depends into a wellbore (not shown) and having thereon an expandable or conventional liner hanger 12, a sliding sleeve 14 (to allow hanger setting), a swivel and seal 16, an expandable sand control screen 18, an isolation valve 20, a swivel and seal 22, and a retrievable bottom hole assembly 25. The sliding sleeve 14, or other similar arrangement, allows for hanger setting. The swivels 16 and 22 free the expandable screen 18 from torque while their related seals allow circulation to the bit. The isolation valve 20 closes and seals the expandable liner after the high cost bottom hole assemble has been recovered.

The subject expandable sand control system (mounted on either solid or slotted pipe) has an inner string to isolate the sand screen. This allows for drilling fluids to be circulated to the bottom of the drilling assembly, before returning up the annulus as normal. Both the upper and lower parts of the expandable sand screen are mounted on the inner string by means of a swivel and seals. The swivel allows for drill string rotation (if needed), the seals ensure that drilling fluids do not circulate to the inside of the screens. The inner string is integral with the internals of the bottomhole drilling assembly, allowing for retrieval of the bottomhole assembly, including a pilot bit. Upon retrieval an isolation valve will close and seal thus providing sand control integrity in the well. Release from the sand screen will be by pumping a ball down the string and engaging this in a catcher to slim the sliding sleeve open, giving hydraulic access to the liner hanger and engaging slips (or other setting mechanism) in the previous casing. Further pressure will release the ball into a catcher, restoring communication through the drill string in case this is needed for well control or circulation purposes.

The present invention may be subject to many modifications and changes without departing from the spirit or essential characteristics thereof. The present specification should therefor be considered in all respects as being illustrative and not restrictive of the scope of the invention as defined by the appended claims.

We claim:

1. An apparatus for drilling and completing a wellbore, comprising:

an inner drill string having a retrievable bottom hole assembly at the lower end thereof;

a generally cylindrical expandable sand control screen mounted about said inner drill string;

swivel and seal means mounted between both upper and lower ends of said expandable sand screen and said inner drill string to allow for drill string rotation and to ensure that drilling fluids do not circulate to the inside of said sand control screen; and isolation valve means at the lower end of said sand screen to close and seal said lower end of said sand screen when said inner drill string and bottom hole assembly are removed thus providing sand control integrity in the well.

2. The apparatus for drilling and completing a wellbore according to claim 1 wherein;

said sand screen is mounted on slotted pipe.

3. The apparatus for drilling and completing a wellbore according to claim 1 wherein;

said sand screen is mounted on solid pipe.

4. The apparatus for drilling and completing a wellbore according to claim 1 further comprising:

means to release the sand screen from said bottom hole assembly by pumping a ball down the inner string to engage in a catcher to shim a sliding sleeve open thereby providing hydraulic access to liner hanger and engaging slips.

5. A method for drilling and completing a wellbore, comprising the steps of:

providing an inner drill string having a retrievable bottom hole assembly at the lower end thereof;

providing a generally cylindrical expandable sand control screen mounted about said inner drill string in close proximity to said bottom hole assembly;

providing swivel and seal means mounted between both upper and lower ends of said expandable sand screen and said inner drill string to allow for drill string rotation and to ensure that drilling fluids do not circulate to the inside of said sand control screen;

providing isolation valve means at the lower end of said sand screen to close and seal said lower end of said sand screen;

drilling said wellbore to the desired depth;

expanding said sand control screen;

releasing and recovering said bottom hole assembly while closing said isolation valve means thus providing sand control integrity in the well.

6. The method for drilling and completing a wellbore according to claim 5, wherein;

said sand screen is mounted on slotted pipe.

7. The method for drilling and completing a wellbore according to claim 5, wherein;

said sand screen is mounted on solid pipe.

8. The method for drilling and completing a wellbore according to claim 5 wherein said step of releasing the sand screen from said bottom hole assembly comprises:

pumping a ball down the inner string to engage in a catcher to shim a sliding sleeve open thereby providing hydraulic access to liner hanger and engaging slips.

* * * * *